United States Patent [19]

Yasumoto

[11] Patent Number: 4,741,702

[45] Date of Patent: May 3, 1988

[54] PHASE-ADJUSTABLE COAXIAL CABLE CONNECTOR

[75] Inventor: Hiromi Yasumoto, Saitama, Japan

[73] Assignee: Junkosha Co., Ltd., Tokyo, Japan

[21] Appl. No.: 91,644

[22] Filed: Aug. 31, 1987

[30] Foreign Application Priority Data

Oct. 3, 1986 [JP] Japan ..... 61-235840

[51] Int. Cl.[4] ..... H01R 39/00

[52] U.S. Cl. ..... 439/13; 439/14; 439/22; 439/578

[58] Field of Search ..... 439/1, 6, 9, 11, 13, 439/14, 18, 19, 20, 21, 22, 24, 25, 27, 578, 585, 675, 668, 669, 518, 170, 171, 173, 174; 324/84, 58 R, 58 A; 29/593, 863, 705

[56] References Cited

U.S. PATENT DOCUMENTS

| | | | |
|---|---|---|---|
| 3,408,610 | 10/1968 | Clarkson | 439/18 |
| 3,663,901 | 5/1972 | Forney, Jr. | 439/585 |
| 3,697,930 | 10/1972 | Shirey | 439/583 |
| 3,904,264 | 9/1975 | Oertle | 439/581 |
| 4,110,716 | 8/1978 | Nikitas | 439/583 |
| 4,441,781 | 4/1984 | Forney, Jr. et al. | 439/584 |

*Primary Examiner*—Gil Weidenfeld
*Assistant Examiner*—David Pirlot
*Attorney, Agent, or Firm*—Mortenson & Uebler

[57] ABSTRACT

A phase-adjustable coaxial cable connector is provided which adjusts the length of the phase path of the system without changing the length of the connector. The electrical path length is adjusted by relative rotation of electrical conductors in the connector.

8 Claims, 1 Drawing Sheet

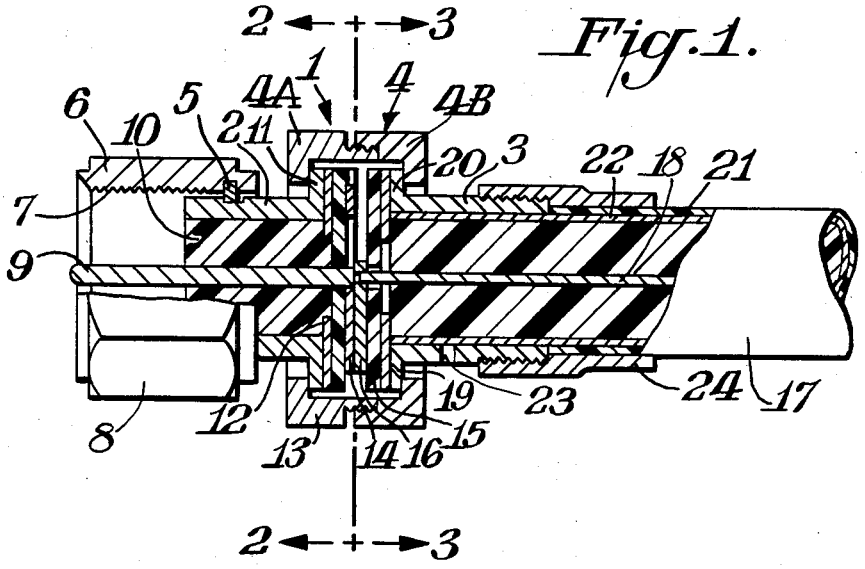
Fig. 1.
Fig. 2.
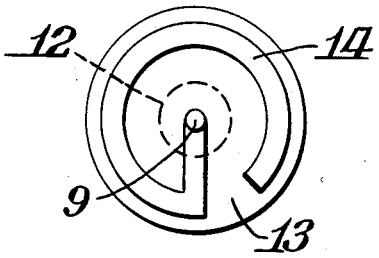
Fig. 3.
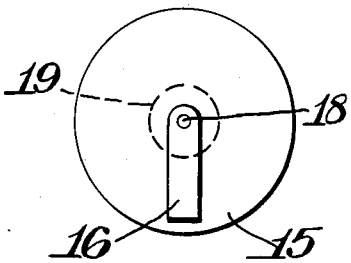

PHASE-ADJUSTABLE COAXIAL CABLE CONNECTOR

BACKGROUND OF THE INVENTION

The present invention relates to a coaxial cable connector which simplifies phase adjustment at terminal assembly of the coaxial cable.

Coaxial connectors which are intended for interconnection of the ends of coaxial cables are known in the art and described, for example, in Japanese Patent Publication (Kokai) No. 57-44,980.

In the case where such coaxial connectors are used in a coaxial cable assembly incorporated into a phase-array system of a radar which requires a predetermined phase, the coaxial connector is attached to one end of the coaxial cable, which preliminarily is provided with an excess length, which is then cut to a predetermined length on the basis of measurement of the phase by means of a pulse-reflection method. After matching the phase to the required value, another coaxial connector is attached to the opposite end of the cable. This is a very lengthy, expensive and inefficient procedure, especially in those cases where the cable is occasionally cut to a length which is shorter than required.

The present invention is aimed at the elimination of the disadvantages inherent in the prior art devices and provides a coaxial cable connector which eliminates the possibility of wasting cable and makes it possible to adjust the phase of the cable.

SUMMARY OF THE INVENTION

A phase-adjustable coaxial cable connector is provided comprising a connector housing supporting a metal coupling at one end of the housing and a coaxial cable at the other end of the housing, the coaxial cable having a center conductor and an outer shield separated from the center conductor by a dielectric material, the coupling supporting a central connecting and conducting pin element supported by a dielectric material which separates the coupling and the pin element, one end of the pin element being adjacent an end of the center conductor whereat a first electrical conductor affixed to the center conductor extends perpendicular to the center conductor, this first conductor being in electrical contact with and rotationally moveable with respect to a second, open-circuit electrical conductor affixed to the one end of the pin element and being perpendicular thereto, whereby, rotation of the first electrical conductor with respect to the second electrical conductor provides means for adjusting the electrical path length of the connector to permit phase adjustability. The first electrical conductor may be ribbon-like in shape. The second electrical conductor may be "G"-like in shape, star-like in shape, shaped as a flower or it may have a zigzag shape. The center conductor and the pin element may be provided with characteristic-impedance-matching means at their adjacent ends.

BRIEF DESCRIPTION OF THE DRAWINGS

FIG. 1 is a side elevational view, partly in cross section, of a phase-adjustable coaxial cable connector according to one embodiment of the invention.

FIG. 2 is an elevational view taken along line 2—2 of FIG. 1.

FIG. 3 is an elevational view taken along line 3—3 of FIG. 1.

DETAILED DESCRIPTION OF THE INVENTION AND PREFERRED EMBODIMENTS WITH REFERENCE TO THE DRAWINGS

A phase-adjustable coaxial cable is provided which adjusts the length of the phase path of the system without changing the length of the connector. The electrical path length is adjusted by relative rotation of electrical conductors in the connector.

More specifically, the above objective is achieved by means of the present invention which provides a phase-adjustable coaxial connector provided with rotatable means for controlling the phase-path length of the connector. These means are placed between a central contact element of the connector on one end and a central conductor of the coaxial cable on the other end.

According to one aspect of the invention, the phase-adjustable coaxial connector comprises a first connector cylinder which supports, through a dielectric body, a central contact element, and has a coupling element at one end and an open-circuit element on the end face at the other end, the above-mentioned open-circuit element being in electrical contact with the central contact element, and a second connector cylinder which is located adjacent to the first connector cylinder and maintained in electrical contact with the central conductor at its one end and with the contact element through engagement with the open-circuit element, and a holder which supports adjacent ends of both connector cylinders. In the above-described construction, the first and second connector cylinders are provided at their adjacent ends with characteristic-impedance-matching means.

Because the coaxial cable connector of the present invention has a rotatable phase-path adjusting means installed between the central conductor of the coaxial cable and the central contact element, the connector eliminates the cable length cutting operation as the phase adjustment procedure.

In other words, without change in the length of the connector, the adjustment can be easily performed by relative rotation of the connector parts.

In accordance with the invention, the connector comprises a first cylinder which has at one end a coupling element and supports a central contact element, and at the other end face has an open-circuit element which is in electrical contact with the above-mentioned central contact element, and a second connector cylinder which supports the coaxial cable and also has a contact element which is in electrical contact with the central conductor of the cable. It is possible, in this construction, to perform microscopic adjustment of the phase-path length of the central conductor by turning the contact element with respect to the open-circuit element of the connector.

Both connector cylinders are locked together by means of a holder.

In the vicinity of the open-circuit element, or near the contact element of the connector cylinder, the connector is provided with a characteristic-impedance-matching conductor which is used for matching the value of characteristic impedance.

By rotating two parts of the holder with respect to each other, it is possible to disconnect both connector cylinders. A coaxial cable is attached to the second connector cylinder. Both connector cylinders are brought in contact at their ends, and then both connector cylinders are locked by screwing together the parts of the holder.

A detailed description of the invention is best provided by reference to the accompanying drawings.

FIG. 1 is a partially-sectional side view of a phase-adjustable coaxial connector 1, made in accordance with one embodiment of the present invention. This phase-adjustable coaxial connector has a first connector cylinder 2 and a second connector cylinder 3 which are held together by a ring-shaped holder 4.

First connector cylinder 2 has at one end a rotatable coupling element 6 which is fixed against axial movement by a cotter ring 5. The coupling element 6 has a female thread 7 on its inner side and a hexagonal configuration 8 on its outer side. It can be connected, for example, to an external electronic device. The coupling element is made of a conductive material and may have a conductive connection through external connecting means.

A central connecting element 9, which is intended for electrical connection of a central conductor, is supported by said first connector cylinder through a dielectric body 10.

The other end of the above-mentioned first connector cylinder 2 has a flange 11 on its end surface and is electrically connected to a characteristic-impedance-matching conductor ring 12. The end face of characteristic-impedance-matching conductor ring 12 supports a dielectric element 13 and an open-circuit element 14, which are located sequentially one after the other. Open-circuit element 14 is electrically connected to central connecting element 9, and may have a "G"-like configuration as shown in FIG. 2. It is understood, however, that the "G"-like configuration is given only as an example, and that open-circuit element may have any other suitable configuration, such as a spiral-shaped, star-shaped, flower-shaped, or a zigzag-shaped configuration.

Second connector cylinder 3, which is located adjacent to first connector 2, has on its end face a dielectric element 15 and a contact element 16, the preferable shape of which is shown in FIG. 3. On one of its ends, the above-mentioned contact element 16 is in electrical contact with open-circuit element 14, while the other end of element 16 is in electrical contact with a central conductor 18 of coaxial cable 17 supported by second connector cylinder 3. The back side of disk-like dielectric element 15 has a characteristic-impedance-matching conductor 19, which is attached to a flange portion 20 of second connector cylinder 3 and is maintained in electrical contact with the latter.

An outer sheath 21 is peeled from the front end of external conductive element 22 of coaxial cable 17 and is then inserted in the above-mentioned second connector cylinder 3. A solder is introduced through a solder-supply opening 23, and external conductive shield element 22 is soldered to second connector cylinder 3. At the same time, permanent electrical contact is established between both parts through the soldering connection. In a similar manner, central conductor 18 is soldered to contact element 16. A cable-supporting ring 24 is then screwed onto second connector cylinder 3. As a result, coaxial cable 17 is firmly attached to second connector cylinder 3.

First connector cylinder 2 and second connector cylinder 3, with coaxial cable 17 attached thereto, are brought in contact at their adjacent ends and then fixed in this position by screwing together the threaded halves 4A and 4B of holder 4.

The phase of coaxial cable 17 can be measured by a pulse-passing method, after connecting one end of the coaxial cable to a phase-adjustable connector of the present invention, and connecting the other end of the coaxial cable to an oscilloscope. If the phase does not correspond to a required value, holder 4 is loosened, first connector cylinder 2 is turned with respect to second connector cylinder 3, so that open-circuit element 14 is turned with respect to contact element 16. This will change the position of electrical contact between both elements, and thus will adjust the actual phase-path length of the central conductor of the cable. After adjustment, the value of the phase is measured for the second time. Thus, the invention eliminates the necessity of cutting the end of the coaxial cable as a measure of its phase adjustment. The phase of the coaxial cable can be quickly and simply adjusted to a required permanent value.

It is understood that the invention is not limited to the above-described embodiment. For example, the elements of the holder can be interconnected permanently through a flat seam. Adjustment of relative positions between the open-circuit element and contact element, which are embedded into the end surfaces of respective disk-like dielectric bodies, can be controlled through a lever or a rotating knob. The central contact element can be made as a female element, and contact can be achieved through the use of a coupling other than the one shown. Thus, any modifications which are within the scope of the principles of the present invention are possible.

It has been shown that the present invention provides a coaxial connector which has means for adjustment of the cable phase-path length by relative rotation of parts of the connector with the above-mentioned means, being installed between the central contact element and central conductor. According to another aspect of the invention, a phase-adjustable coaxial connector may comprise a first connector cylinder which supports through a dielectric body a central contact element, and has a coupling element at one end and an open-circuit element on the end face at the other end, the above-mentioned open-circuit element being in electrical contact with the above-mentioned central contact element, and a second connector cylinder which is located adjacent to the first connector cylinder and maintained in electrical contact with the central conductor at its one end and with the contact element through engagement with the open-circuit element, and a holder which supports adjacent ends of both connector cylinders.

The use of the coaxial connector of the above-described type provides the following advantages:

(1) Because measurement of the phase can be performed with installation of the connectors at both ends of a coaxial cable, it is possible to measure the phase by a pulse-passing method. This will result in high accuracy of measurement and will provide a coaxial cable assembly with high accuracy of the phase.

(2) The invention eliminates the cable cutting operation as a phase-adjustment procedure. As a result, the time and expense required for the manufacture of the coaxial cable assembly is reduced.

(3) Elimination of the cable cutting operation as a phase-adjustment procedure eliminates problems which may occur in the case when the cable is cut shorter than the allowable limit.

(4) The adjustment operation is very simple and does not require skilled labor.

(5) Because the effective length of the conductor (phase-path length), i.e., the phase, is adjusted by relative rotation, it is not necessary to vary the length of the connector, to change the design of the instrument, or to restrict the degree of freedom in the connection.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A phase-adjustable coaxial cable connector comprising a connector housing supporting a metal coupling at one end of said housing and a coaxial cable at the other end of said housing, said coaxial cable having a center conductor and an outer shield separated from said center conductor by a dielectric material, said coupling supporting a central connecting and conducting pin element supported by a dielectric material which separates said coupling and said pin element, one end of said pin element being adjacent an end of said center conductor whereat a first electrical conductor affixed to said center conductor extends perpendicular to said center conductor, said first conductor being in electrical contact with and rotationally moveable with respect to a second open-circuit electrical conductor affixed to said one end of said pin element and being perpendicular thereto, whereby, rotation of said first electrical conductor with respect to said second electrical conductor provides means for adjusting the electrical path length of said connector to permit phase adjustability.

2. The connector according to claim 1 wherein said first electrical conductor is ribbon-like in shape.

3. The connector according to claim 1 wherein said second electrical conductor is "G"-like in shape.

4. The connector according to claim 1 wherein said second electrical conductor is spirally shaped.

5. The connector according to claim 1 wherein said second electrical conductor is star-like in shape.

6. The connector according to claim 1 wherein said second electrical conductor is shaped as a flower.

7. The connector according to claim 1 wherein said second electrical conductor is in a zigzag shape.

8. The connector according to claim 1 wherein said center conductor and said pin element are provided with characteristic-impedance-matching means at their adjacent ends.

* * * * *